United States Patent [19]

Sherwood

[11] 4,266,841

[45] May 12, 1981

[54] HIGH VOLTAGE CABLE TERMINAL

[75] Inventor: Cy E. Sherwood, Bainbridge, N.Y.

[73] Assignee: The Bendix Corporation, Southfield, Mich.

[21] Appl. No.: 88,430

[22] Filed: Oct. 25, 1979

[51] Int. Cl.[3] ..... H01R 13/62; H01T 13/06; H01T 13/20

[52] U.S. Cl. ..... 339/89 C; 339/143 S

[58] Field of Search ..... 339/26, 89 C, 140 S, 339/143 S; 313/137, 144, 145, 135; 174/35 SM, 152 S

[56] References Cited

U.S. PATENT DOCUMENTS

| | | | |
|---|---|---|---|
| 1,009,004 | 9/1914 | Meyer | 313/137 X |
| 2,109,029 | 2/1938 | Nowosielski | 313/135 X |
| 2,913,696 | 11/1959 | Burgher | 339/26 |
| 4,145,106 | 3/1979 | Livingston | 339/143 S |

*Primary Examiner*—Eugene F. Desmond
*Attorney, Agent, or Firm*—Richard V. Westerhoff; Raymond J. Eifler; Charles D. Lacina

[57] ABSTRACT

A terminal for mating the end of a high voltage cable with a standard receptacle comprises a flanged bushing extending along the cable and a ceramic sleeve which slides over the bushing and abuts the flange. A ferrule slidable on the cable and over the ceramic sleeve retains a single helical compression spring which bears against the bushing and ceramic sleeve to apply a preselected spring force to an electrical contact retained in the end of the ceramic sleeve. A resilient annular grommet slidably engages the exterior surface of the ceramic sleeve through an internal annular bead on the grommet and is axially compressed between the ferrule and a mating part on the receptacle to effect an altitude seal.

9 Claims, 3 Drawing Figures

HIGH VOLTAGE CABLE TERMINAL

BACKGROUND OF THE INVENTION

1. Field of the Invention

This invention relates to electrical terminals and, more specifically, to electrical terminals for high voltage insulated cables such as those used with aircraft ignition systems.

2. Prior Art

Terminals for cables used in aircraft ignition systems are subject to extreme operating conditions. The very high voltages used can cause burning and deterioration of the electrical contacts in the terminals if adequate electrical contact is not made between the mating parts. In addition, the reduced atmospheric pressure in which these systems operate increases the tendency for flashover or short-circuiting to occur. Furthermore, the high temperatures to which the terminals are exposed accelerates the deterioration of the seals used to prevent flashover.

Standards have been set for terminals and the receptacles with which they mate to ensure the compatability of parts made by different manufacturers. One type of receptacle used with high voltage aircraft ignition systems is the ARP 670-4F. This receptacle has an electrical contact recessed in an insulator sleeve which in turn is recessed in an externally threaded metallic sleeve. This receptacle is designed to mate with an ARP 670-4M terminal. This standard terminal has an electrical contact which extends beyond the end of an elongated insulator dimensioned to be received in the recess in the insulator sleeve of the receptacle. An internally threaded coupling nut which is retained by a shoulder on a ferrule forming part of the terminal threadedly engages the metallic sleeve on the receptacle to securely mate the terminal and the receptacle.

While the standards set the dimensions and the tolerances for the mating parts of the receptacle and terminal, the internal arrangement for the seals and means for biasing the terminal contact toward the receptacle contact are not specified. In the present terminal made by the assignee of the present invention, a resilient grommet slidable on the elongated insulator of the terminal is compressed against the end of the insulator sleeve on the receptacle by a helical compression spring encircling the terminal insulator and the cable. A second helical compression spring bears against a resilient bushing abutting the end of the terminal insulator to urge the terminal contact secured to the end of the terminal insulator against the receptacle contact. By providing two springs, the contacts and the sealing grommets may both be seated with the required force despite variations in the tolerances of the parts of both the terminal and the receptacle. Captivation assemblies are utilized to pre-load the springs which in turn keep the overall terminal assembly shorter.

While the above mentioned terminal has been successfully used over a period of about fifteen years, there is room for improvement. Interference can occur between the grommet and the inner spring which inhibits movement of the terminal insulator, allowing an air gap to be present between the supposedly mated contacts which results in contact burning. This interference also increases the insertion force required to mate the terminal with a receptacle. Furthermore, interference between the grommet and the mainspring precludes the grommet from sliding freely over the terminal insulator so that the correct pressure is not applied through the grommet, thereby increasing the probability of flashover at altitude. Another problem area with the present design is deterioration of the sealing grommet and bushing when they have been subjected to high temperatures. The bushing tends to vulcanize to the jacket of the cable and the grommet vulcanizes to either the ceramic sleeve or to the mating receptacle. When unmating, the vulcanized grommet tears apart or remains in the receptacle necessitating more extensive field repair.

It is an object of the present invention to provide a simple, reliable high voltage terminal.

It is another object of the invention to provide a high voltage terminal which has a longer life and is less costly to manufacture than present terminals.

It is yet another object of the present invention to reduce the incidence of high insertion forces, high altitude seal failure and contact burning in high voltage terminals.

More specifically, it is an object of the present invention to eliminate interference between the sealing grommet and the spring assembly in high voltage terminals currently used.

It is also a specific object of the present invention to eliminate one spring and the spring captivation assemblies of the high voltage terminals currently in use.

It is another specific object of the invention to slow down the deterioration of the grommets and bushings of high voltage terminals under environmental stress.

SUMMARY OF THE INVENTION

According to the invention, an electrical terminal (1) for the end of an insulated high voltage electrical cable (3) comprises elongated annular insulating means which slides over and extends along the end of the insulated cable. An electrical contact (5) affixed to the end of the electrical conductor (4) in the cable (3) is secured to the annular insulating means (7, 11) with the contact (5) extending beyond the free end of the insulating means (7, 11). An elongated annular ferrule (17) which is slidable on the cable (3) and over the insulating means (7, 11) is retained on the cable (3) by a radial, inwardly directed flange (19) on the end of the ferrule remote from the end of the cable. A single biasing means, preferably in the form of a helical compression spring (23), biases the insulating means (7, 11) away from the flange (19) on the ferrule (17). A resilient, electrically insulating grommet (27) slidably engages the exterior surface of the annular insulating means (11) and also engages the ferrule (17). An internally threaded coupling nut (37) engages a shoulder (41) on the ferrule (17) for connecting the terminal (1) to a receptacle (45) having an electrical contact (47) recessed in an insulator sleeve (49) which in turn is recessed in an externally threaded metallic sleeve (51). The annular insulating means (7, 11) of the terminal (1) slides into the insulator sleeve (49) on the receptacle (45) to bring the two electrical contacts (5, 47) into circuit completing engagement as the coupling nut (37) is threaded onto the metallic sleeve (51) of the receptable (45). At the same time, the end of the insulator sleeve (49) on the receptacle (45) compresses the resilient grommet (27) against the ferrule (17) to provide the high altitude seal.

Preferably, the insulating means of the terminal (1) includes a flexible electrically insulating bushing (7) and a rigid insulating sleeve (11). The bushing (7) extends along the cable (3) from the end thereof with a radial, outwardly directed flange (9) disposed at the end of the bushing remote from the end of the cable. The rigid insulating sleeve (11) slides over the bushing (7) and abuts the flange (9). A washer (25) can be placed between the helical compression spring (23) and the flange (9) on the bushing (7). The grommet (27) slidably engages the outer surface of the rigid insulating sleeve (11). Preferably, the grommet (27) engages the insulating sleeve (11) through an annular internal bead (29) and engages the ferrule (17) through mating annular shoulders (31, 33). The single spring (23) assures that the proper force is maintained between the electrical contacts (5, 47) while the resiliency of the grommet (27) assures a tight high altitude seal.

The elimination of one spring and the spring captivation assemblies eliminates grommet interference which in turn reduces the incidence of high insertion forces, altitude seal failure and contact burning. The use of a grommet (27) which engages the insulating sleeve of the terminal through an internal annular bead (27) and the use of a fluorelastomer material for the grommet and bushing decreases the rate of deterioration of these parts under environmental stresses and makes disassembly easier and with less damage than with the prior art design. Furthermore, the elimination of one spring and the spring captivation assemblies and the reduced size of the ferrule results in an assembly which is less costly to manufacture.

DESCRIPTION OF THE PREFERRED EMBODIMENT

Figure 1:
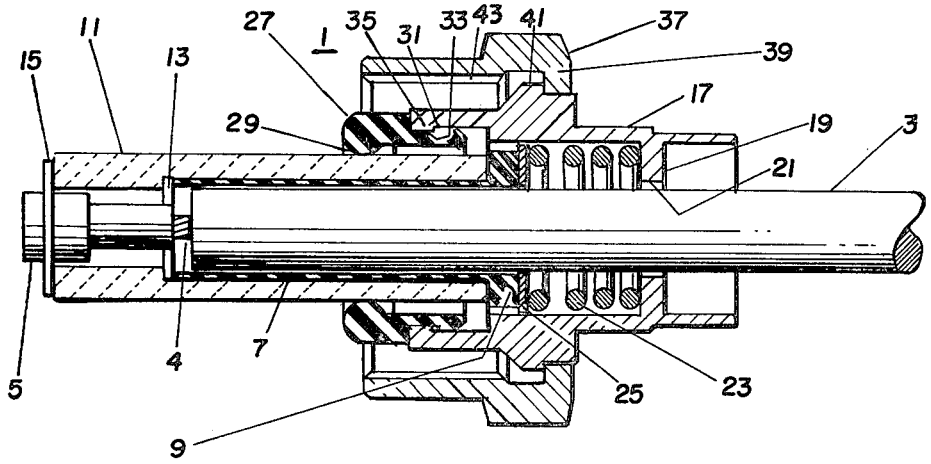
FIG. 1 is a longitudinal section through a high voltage terminal made in accordance with the teachings of this invention.
Figure 2:
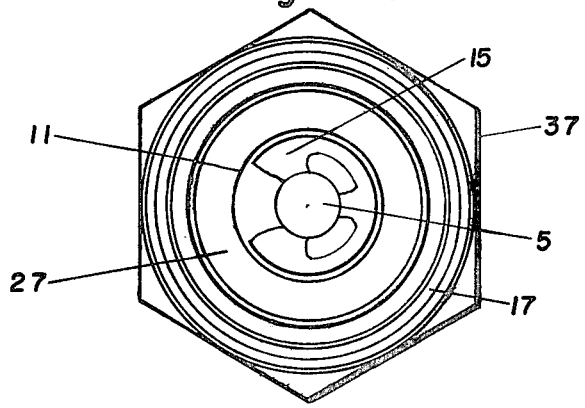
FIG. 2 is an end view of the terminal of FIG. 1.

FIGS. 1 and 2 illustrate a terminal 1 for the end of a jacketed high voltage cable 3. The cable 3 has an electrical conductor 4 to which is affixed a contact such as the tungsten tipped electrical contact 5. A flexible, electrically insulating sleeve 7 extends axially along the cable from the end thereof and is provided with a radial, outwardly extending flange 9 at the end remote from the end of the cable. A ceramic sleeve 11 is counterbored 13 from one end to slide over the bushing 7 and abut the bushing flange 9. The contact 5 is secured at the free end of the ceramic sleeve 11 by a C-shaped retaining ring 15 which engages a groove (not shown) in the contact 5. The bushing 7 eliminates air space between the sleeve 11 and the cable jacket to help prevent flashover. In addition, the bushing effects a squeeze seal which applies constant pressure to the cable jacket to provide additional protection against flashover.

A ferrule 17 is slidable along the cable 3 and at least partially over the bushing 7 and the ceramic sleeve 11. The ferrule is retained on the cable by a radial, inwardly directed flange 19 at the end of the ferrule remote from the end of the cable. The flange 19 defines an aperture 21 which is larger in diameter than the insulated cable 3 but smaller in diameter than the flange 9 on the bushing and the ceramic sleeve 11. Biasing means such as a helical compression spring 23 encircling the insulated cable 3 bears against the ferrule flange 19 and a washer 25 which in turn bears against flange 9 on bushing 7. The washer 25 takes the pressure of spring 23 and distributes it over a larger area of the bushing.

A resilient, electrically insulating grommet 27 slidably engages the exterior of the ceramic insulator 11. Preferably, the grommet 27 engages the ceramic sleeve 11 through an internal annular bead 29 which allows movement of the grommet 27 along the ceramic sleeve 11. The grommet is connected at its other end to the ferrule 17 by an annular external shoulder 31 (formed by a groove 33) which mates with an annular internal shoulder 35 on the ferrule 17. This connection of the grommet 27 to the ferrule 17 serves to retain the ferrule when the terminal is not mated with a receptacle, assures correct positioning of the grommet during mating, and assures that the grommet stays with the terminal during unmating. The terminal 1 also includes a coupling nut 37 having a radial, inwardly directed flange 39 which engages an annular shoulder 41 on the ferrule. An internal thread 43 on the coupling nut 37 engages an external thread on the receptacle. The grommet 27 and bushing 7 are made of a resilient, electrically insulating material which can resist high operating temperatures. Fluorelastomers are suitable for this purpose.

Figure 3:
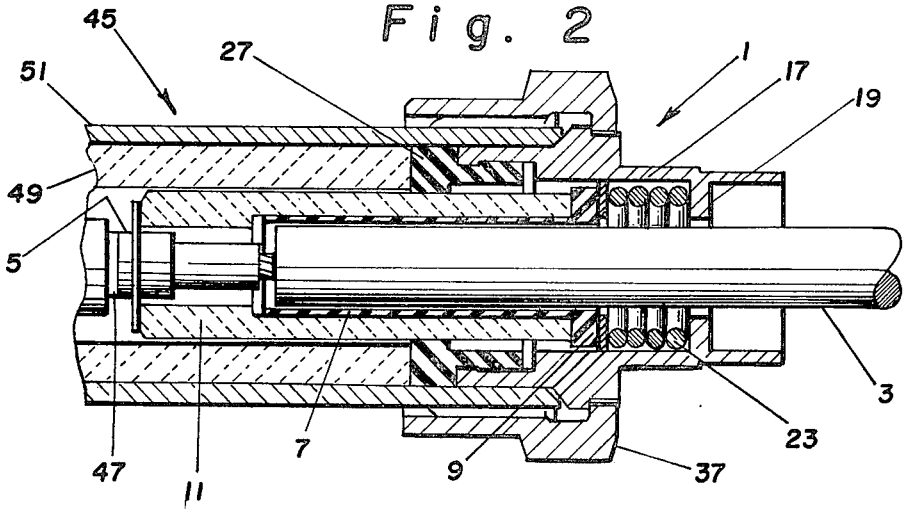
FIG. 3 is a longitudinal section of the terminal of FIG. 1 in mating relationship with a receptacle.

FIG. 3 illustrates the terminal 1 in mating relationship with a receptacle 45. The receptacle includes a contact such as a tungsten tipped contact 47 recessed in a rigid insulator sleeve 49 which in turn is recessed in an externally threaded metallic sleeve 51. The ceramic sleeve 11 of the terminal slides into the bore of the rigid insulator sleeve 49 of the receptacle until the contacts 5 and 47 touch. As the coupling nut 37 is threaded onto the metallic sleeve 51 of the receptacle, the grommet 27 is compressed between the ferrule 17 and the insulator sleeve 49 of the receptacle to effect a seal for the connection. At the same time, the spring 23 is compressed to maintain a preselected force between the contacts 5 and 47. Since all of the force of the spring 23 is applied to the contact 5, a good electrical connection is made and there are no air gaps between the terminals which can cause rapid erosion of the contacts. With the disclosed arrangement, there is no interference between the grommet and a spring to cause high insertion forces, high altitude seal failure or contact burning. The configuration and materials used in making the grommet 27 and bushing 7 reduce the rate of deterioration of these parts and the tendency of the grommet to tear during unmating.

In the mated condition the sleeve 11 provides an insulation barrier between the contacts 5 and 47 which are at voltage potential and the ferrule 17, coupling nut 37 and the metallic sleeve 51 of the mating receptacle, all of which are at ground potential. The grommet 27 provides an altitude seal in the mated condition which eliminates flashover from the voltage potential to ground. The ferrule 17 in the mated condition applies direct pressure between the grommet 27 and the mating receptacle and maintains contact pressure through the spring 23, washer 25, bushing 7 and sleeve 11.

While a specific embodiment of the invention has been disclosed in detail, those skilled in the art will appreciate that modifications and alternatives to those details can be made which all fall fully within the scope of the invention. Accordingly, the details disclosed herein are meant to be illustrative only and not limiting on the scope of the invention which is to be given the full breadth of the appended claims and all equivalents thereof.

What is claimed is:

1. An electrical terminal for the end of an insulated high voltage electrical conductor cable comprising:

elongated annular insulating means surrounding and extending along the end of the insulated cable;

an electrical contact affixed to the end of the electrical conductor in the insulated cable;

means for securing the electrical contact to the free end of the elongated annular insulating means;

an elongated annular ferrule slidable on the cable and over the insulating means, said ferrule having a radial, inwardly directed flange adjacent the end thereof remote from the end of the cable, said flange defining an aperture larger in diameter than the cable but smaller in diameter than the insulating means, such that the ferrule cannot slide off the end of the cable;

a single biasing means between the ferrule flange and the end of the insulating means remote from the cable end for biasing the insulating means axially away from the flange;

an elongated annular electrically insulating grommet having a flexible internal annular lip which slidably engages the annular insulating means and also having an external portion which engages said ferrule; and a coupling nut which engages a shoulder on the ferrule for securing the terminal to a mating receptacle.

2. The terminal of claim 1 wherein said elongated annular insulating means comprises a rigid, hollow electrically insulating sleeve having an outer cylindrical surface, and a resilient, elongated electrically insulating bushing disposed inside the hollow sleeve, said bushing having a radial, outwardly directed flange at the end remote from the end of the cable, which flange bears against the end of said sleeve.

3. The terminal of claim 2 wherein said single biasing means is a single helical compression spring which encircles said cable.

4. The terminal of claim 3 including a washer between said bushing and said helical compression spring.

5. The terminal of claim 1 wherein said elongated annular grommet slidably engages the outer cylindrical surface by means of the flexible internal annular lip on the grommet.

6. The terminal of claim 5 wherein said hip is on the end of the elongated grommet toward the end of the cable and wherein the grommet engages the ferrule through mating annular ribs adjacent the other end of the grommet and adjacent the end of the ferrule facing the end of the cable.

7. An electrical terminal for mating a high voltage insulated cable with a receptacle having a first electrical contact recessed in a rigid insulator sleeve which in turn is recessed in an externally threaded metallic sleeve, said terminal comprising:

a flexible, electrically insulating bushing extending axially along the cable from the end thereof and having a radial, outwardly directed flange at the end remote from the end of the cable;

a ceramic sleeve which fits over the bushing on the end of the cable and abuts the flange on said bushing, said ceramic sleeve being of an external diameter which mates with a recess in the insulator sleeve of said receptacle;

a second electrical contact affixed to the end of the electrical conductor in said insulated cable;

means for securing said second electrical contact to the ceramic sleeve with said second contact extending axially beyond the free end of said ceramic sleeve;

an elongated annular ferrule which slides on said insulated cable and at least partially over the ceramic sleeve, said ferrule being retained on said cable by a radial, inwardly directed flange on the end thereof remote from the end of the cable;

a single helical compression spring encircling the insulated cable between said ferrule flange and said bushing flange for biasing these flanges axially away from each other;

an annular, electrically insulating grommet which slidably engages the ceramic sleeve and also engages the ferrule; and an internally threaded coupling nut which engages a shoulder on said ferrule and threadedly engages the external threads on the metallic sleeve of said receptacle to draw the ceramic sleeve of the terminal inside the insulator sleeve of the receptacle to bring the first and second electrical contacts into circuit completing contact, with the helical compression spring maintaining a preselected force between the contacts as the ferrule slides over the ceramic sleeve and compresses the flexible grommet against the end of the insulator sleeve on the receptacle to effect a good electrical contact which is well insulated.

8. The terminal of claim 7 wherein said grommet engages said ceramic sleeve through an internal annular bead.

9. The terminal of claim 8 wherein the grommet engages said ferrule through mating annular shoulders on said grommet and said ferrule.

* * * * *